United States Patent [19]

Deutsch

[11] 4,350,072

[45] Sep. 21, 1982

[54] REENTRANT REVERBERATION GENERATOR FOR AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 257,069

[22] Filed: Apr. 24, 1981

[51] Int. Cl.[3] ..... G10H 1/02

[52] U.S. Cl. ..... 84/1.24; 84/DIG. 26; 84/DIG. 4; 179/1 J

[58] Field of Search ..... 84/1.24, 1.01, DIG. 4, 84/DIG. 26; 179/1 J

[56] References Cited

U.S. PATENT DOCUMENTS

| | | | |
|---|---|---|---|
| 4,005,268 | 1/1977 | Canell et al. | 179/1 J |
| 4,105,864 | 8/1978 | Berkovitz | 179/1 J |
| 4,112,803 | 9/1978 | Deutsch | 84/DIG. 4 |
| 4,194,426 | 3/1980 | Deutsch et al. | 84/DIG. 26 |
| 4,205,580 | 6/1980 | Deutsch | 84/DIG. 4 |
| 4,219,880 | 8/1980 | Nichols | 179/1 J |
| 4,244,262 | 1/1981 | Imai | 84/DIG. 26 |
| 4,259,888 | 4/1981 | Gross | 84/DIG. 4 |
| 4,275,267 | 6/1981 | Kurtin et al. | 84/DIG. 26 |

*Primary Examiner*—J. V. Truhe
*Assistant Examiner*—Forester W. Isen
*Attorney, Agent, or Firm*—Ralph Deutsch

[57] ABSTRACT

A reverberation effect is produced in a musical tone generator of the type in which waveshape data points are sequentially and repetitively read out of a memory at a rate corresponding to the fundamental pitch of a musical tone. The reverberation effect is obtained by having a second memory storing waveshape points which are read out simultaneous with those from the first memory. The second data set is scaled by the ADSR envelope function and at selected echo time spacings is pointwise added to the data stored in the first memory. The data read out of the first memory is converted to an analog musical signal having a reverberation effect during the attack or release phase of the musical tone.

8 Claims, 3 Drawing Figures

REENTRANT REVERBERATION GENERATOR FOR AN ELECTRONIC MUSICAL INSTRUMENT

BACKGROUND OF THE INVENTION

1. Field of the Invention

This invention relates to electronic musical tone synthesis and in particular is concerned with a means for generating a reverberation effect.

2. Description of the Prior Art

Even a casual listener can detect the difference between musical instruments played in a concert hall and the same instruments played in the home. One of the principal differences in the sound is caused by the acoustics of the playing chambers. Concert halls usually have a construction which provides a long reverberation time produced by a multitude of echoes from partially reflective surfaces. In the home the presence of carpets, drapes, and "acoustical" ceilings quickly attenuates such echoes and thereby produces a rather "dry" and lifeless characteristic for musical sounds.

It has long been recognized that electronic keyboard instruments such as an organ, provide a more "realistic" sound by incorporating reverberation devices which are intended to simulate the reverberation property of large auditoriums. The most commonly used device to create reverberation effects is a metal spring configured to act as an acoustic delay line. The electrical musical signal is converted to a mechanical motion in the spring by means of a transducer similar in function to a speaker driver. A second transducer located at the other end of the spring converts the mechanical vibrations into electrical signals. A portion of the delayed output signal is added to the input signal thereby producing a feedback echo path which produces the desired multiplicity of echoes for the original signal.

The mechanical spring reverberation device is popular because of its low cost. The sound produced by such devices has a mechanical-like tone characteristic which is only remotely similar to the acoustic reverberation quality of a large auditorium.

Along with the current emphasis on digital techniques for musical systems it is obvious that digital techniques would be applied to produce reverberation effects. Unlike the mechanical spring delay line with its transducers producing nonlinear distortion digital storage and signal delay can be accomplished with no distortion by a variety of digital memory devices. A survey of the state of the art in digital reverberation is found in the technical article: Moorer, J. M., "About This Reverberation Business." *Computer Music Journal,* Vol. 3, June 1979, pp. 13–28.

Most digital reverberation devices are based on the use of unit reverberators which are either configured as all-pass digital filters or as comb filters. Each of the unit reverberators produces a signal delay and signal attenuation. The output from a number of unit reverberators is summed to provide a reverberation effect produced by a multiplicity of echoes.

A second digital mechanization approach is to simply imitate the mechanical spring acoustic delay by means of digital storage devices such as shift registers or addressable memories such as RAM (random access memory).

In U.S. Pat. No. 4,194,426 entitled "Echo Effect For An Electronic Musical Instrument," a system is described in which a musical tone is repeated at a controlled repetitive rate but with decreasing peak amplitude when a key is released from the musical instrument's keyboard. This echo effect is obtained by generating a repetitively decaying amplitude modulation function and does not produce the tonal effect associated with the reverberation produced by multiple reflections in an acoustic chamber such as an auditorium.

SUMMARY OF THE INVENTION

The present invention is directed to apparatus for producing a reverberation effect in a musical digital tone generator by employing a feedback signal arrangement.

In a Polyphonic Tone Synthesizer of the type described in U.S. Pat. No. 4,085,644 a computation cycle and a data transfer cycle are repetitively and independently implemented to provide data which are converted to musical waveshapes. During the computation cycle a master data set is generated by implementing a discrete Fourier transform algorithm using stored sets of harmonic coefficients which characterize preselected musical tones. The computations are carried out at a fast rate which may be nonsynchronous with any musical frequency. Preferably the harmonic coefficients and the orthogonal functions required by the Fourier transform algorithm are stored in digital form and the computations are carried out digitally. At the end of a computation cycle the master data set resides in a memory.

Following a computation cycle, a transfer cycle is initiated during which the master data set data are transferred to preselected members of a multiplicity of tone generators. The output tone generation continues uninterrupted during the computation and transfer cycles. The transferred data is stored in a note register.

The master data set stored in the note registers in each of the preselected members of the multiplicity of tone generators is sequentially and repetitively read out of storage and converted to an analog musical waveshape by means of a digital-to-analog converter. The memory addressing rate is proportional to the corresponding fundamental frequency of the musical pitch associated with a tone generator.

The master data set is also transferred and stored in an echo register one of which is associated with each tone generator. During the release phase of the tone generation, data read out of the note register is added pointwise to the data stored in the echo register and the summed data is stored in the note register to replace data that has been read out. The master data set read out of the echo register is attenuated in time in response to a decaying envelope modulation function. The addition of the signals is carried out for a number of points equal to the number of data points in one period of the waveshape. The timing of the adding of the echo signals is controlled by an echo clock which determines the number of multiple echoes that are generated in the tone's release time. Realism of the reverberation effect is attained by adding the individual echo waveforms with a random phase with respect to previous echo waveforms.

It is an object of this invention to provide a reverberation effect in which the number of multiple echoes and the reverberation time can be changed in response to control signals.

BRIEF DESCRIPTION OF THE DRAWINGS

For a better understanding of the invention reference should be made to the accompanying drawings.

DETAILED DESCRIPTION OF THE INVENTION

The present invention is directed to a reverberation effect subsystem incorporated in a musical tone generator of the type that repetitively reads successive waveshape sample points from a memory at a rate corresponding to an actuated switch on the musical instrument's array of keyboard switches. The sample points accessed from the memory are converted into analog musical signals by means of a digital-to-analog converter. Tone generation system of this type is described in detail in U.S. Pat. No. 4,085,644 entitled "Polyphonic Tone Synthesizer" which is hereby incorporated by reference. In the following description all elements of the system which are described in the referenced patent are identified by two digit numbers which correspond to the same numbered elements appearing in the patent. All system element blocks which are identified by three digit numbers correspond to elements added to the Polyphonic Tone Synthesizer to implement the improvements of the present invention to produce a reverberation effect.

The present invention utilizes the experimentally observed phenomenon that the primary tonal effect producted by reverberation is apparent during the release phase of a tone and has little or no effect during the steady state tone generation. In an electronic musical instrument the instant of time for the start of a note release is known. The release time and the release envelope modulation function are also known and controllable quantities. An echo storage device for the entire set of data for the release time is not required because the tone generator itself is used to provide all the data required to imitate a multiple echo reverberation effect.

Figure 1:
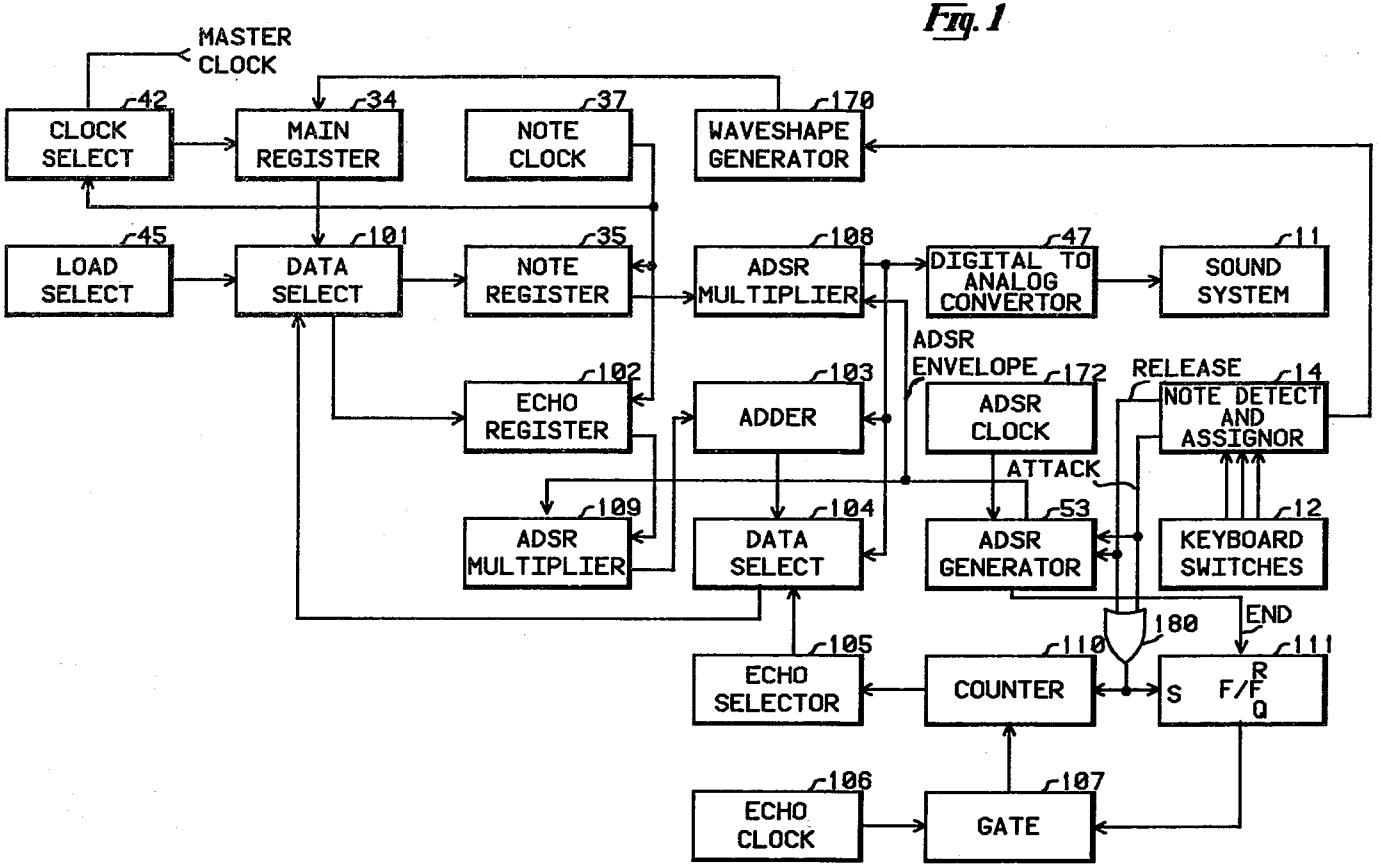
FIG. 1 is a block diagram of a reverberation effect system.

FIG. 1 illustrates a system embodying the present invention.

In response to closures of switches in the array of keyswitches contained in keyboard switches 12, a master data set of points corresponding to equally spaced points for one period of a musical waveshape are generated by means of the waveshape generator 170 as described in the above referenced patent (U.S. Pat. No. 4,085,644). The master data set is stored in the main register 34. The stored master data is transferred during a transfer cycle to a plurality of tone generators assigned to the actuated switches in the keyboard switches 12. Only one of these tone generators is shown explicitly in FIG. 1.

During the transfer cycle, load select 45 will generate a signal when the master data set residing in the main register is to be read out and transferred to a tone generator in response to the signal from the load select 45, data select 101 will transfer the master data set read out from the main register 34 to the note register 35 and the echo register 102.

Stored data is read out of the note shift register 35 and the echo register 102 in the usual end-around fashion under control of timing signals provided by the note clock 37. The note clock 37 is operated at a frequency which is N times the fundamental frequency of the musical note created by the corresponding tone generator. N is the number of elements in the master data set which defines the musical waveshape. There are a variety of methods that can be employed to implement a voltage controlled oscillator which can be used for the note clock 37. One such implementation is described in detail in U.S. Pat. No. 4,067,254 which is hereby incorporated by reference.

The reverberation generation action is initiated when a note has been released. The release of a keyswitch is detected by the note detect and assignor 14 which signals this condition by generating a RELEASE signal. A note detect and assignor subsystem is described in U.S. Pat. No. 4,022,098 entitled "Keyboard Switch Detect And Assignor." This patent is hereby incorporated by reference.

In response to the RELEASE signal the ADSR generator 53 starts to generate a release phase envelope function consisting of release data values, at a rate determined by an adjustable clock 172 associated with the ADSR generator 53. An implementation for the ADSR generator 53 is described in U.S. Pat. No. 4,079,650 entitled "ADSR Generator." This patent is hereby incorporated by reference. The ADSR clock 172 can be adjusted to control the time interval for the release phase of the ADSR envelope function. The reverberation time is equal to the time of the release phase of the ADSR envelope function.

The RELEASE signal is used to initialize the counter 110 to a zero count state and is used to set the flip-flop 111.

When the flip-flop 111 is set, the output logic state Q="1" causes the gate 107 to transfer timing signals from the echo clock 106 to increment the count states of the counter 110. The echo clock 106 function is to determine the delay between the successive pseudo echoes which create the reverberation effect. The echo clock 106 is implemented as a variable frequency clock whose rate can be controlled by the musician.

The echo selector 105 is responsive to the count state of the counter 110 and, in a manner described below, adds "echoes" to the data stored and recirculated in the note register 35.

The function of the echo register 102 is to store the original waveshape data received in the form of the master data set transferred from the main register 34. The data stored in the echo register 102 is scaled in magnitude and added pointwise at selected times with the data recirculated in the end-around operation of the note shift register 35. The times for performing these pointwise additions are determined by the echo selector 105.

The data read out of the echo register 102 is scaled in magnitude by the ADSR multiplier 109. The scaling factors used by the ADSR multiplier 109 are the ADSR envelope function values generated by the ADSR generator 53 and furnished to both the ADSR multiplier 109 and the ADSR multiplier 108. The scaled echo data produced by the ADSR multiplier is pointwise added to the data output produced by the ADSR multiplier 108 by means of the adder 103.

The data select 104 is used to select either the output data produced by the ADSR multiplier 108 or the data having an added echo provided from the output of the adder 103. This data selection, in a manner to be described is controlled by the echo selector 105. It is the action of the data select 104 that adds the pseudo-echo signals to the data provided to the digital-to-analog converter 47 and thereby imitates the reverberation effect created by multiple echoes in an acoustic chamber.

At the conclusion of the release phase of the ADSR generator 53 for the assigned tone generator an END signal is generated. The presence of the END signal resets the flip-flop 111 and thereby prevents the gate 107 from any further transfer of timing pulses from the echo clock 106 to the counter 110.

Figure 2:
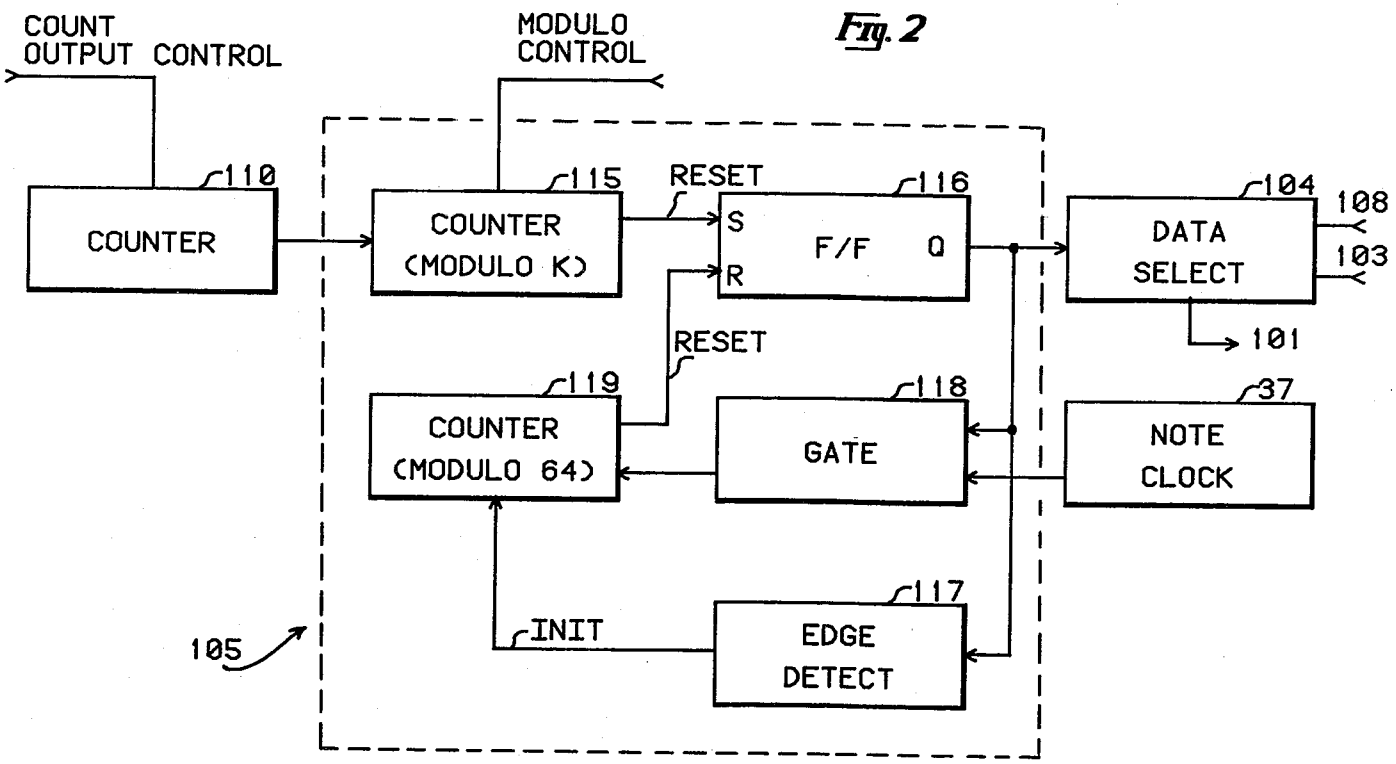
FIG. 2 is a block diagram of the echo selector.

FIG. 2 illustrates the detailed system logic for the echo selector 105. The sixth least significant bit of the binary count state of counter 110 is used to increment the counter 115. At the end of each 64 counts of the counter 110, the sixth least significant bit will change from a logic "0" to a logic "1" state. This change will occur for each 64 timing signals from the echo clock 106. Other count states can be transmitted from the counter 110 depending upon the desired time delays between the pseudo-echoes. These count states can be selected in response to a count output control. An added degree of reverberation realism can be obtained by having the count output control vary as a function of time. This time variation can either be programmed or can be a random variation produced by a random function generator.

The counter 115 is implemented to count modulo a preselected number K. The modulo number K can be varied in response to a modulo control signal provided to the counter 115. The value of K can be used as a second control parameter to vary the time delays between the successive pseudo-echoes. The modulo control signal can be implemented as a steady state signal or can be implemented as a time varying signal to provide added realism to the reverberation effect.

When counter 115 is incremented to return to its initial count state a RESET signal is generated which is used to set the flip-flop 116. When flip-flop 116 is set, its output logic state is Q="1". In response to the state Q="1" data select 104 will select the data provided by the adder 103 to be transferred to the data select 101. His selection control will last for 64 data points as determined by the timing signals provided by the note clock 37.

When flip-flop 116 is set, the edge detect 117 detects the change of state from Q="0" to Q="1" and generates an INIT signal. The INIT signal resets the counter 119 to its initial count state. While the state Q="1" exists for the flip flop 116 output, gate 118 transfers timing signals from the note clock 37 which are used to increment the counter 119. When the counter 119 reaches its maximum count state a RESET signal is generated which causes the flip-flop 116 to be reset. In this fashion data select 104 will transfer 64 data points from the output of the adder 103 to be stored as new data in the note register 35.

The system operation is such that at time intervals controlled by the echo clock 106, and counters 110 and 115, echoes are added to the waveshape data read out of the note register 35. It should be noted that the successive echoes are gradually reduced in magnitude because of the data scaling action of the ADSR multiplier 109. This magnitude reduction matches the overall output tone reduction in magnitude produced by the scaling action of the ADSR multiplier 108. The net result is that during the time interval occupied by a note release a series of echoes are introduced into the data presented to the digital-to-analog converter 47 in which each successive echo has a gradually decaying strength. Moreover since the timing for the introduction of an echo is not locked into some fixed relation with the note clock 37, the successive echoes will be added pointwise in a random phase relation with respect to the "main tone" corresponding to the data currently read out of the note register 35.

Various modifications can be made to the fundamental reverberation system previously described. It is obvious to extend the system so that the reverberation effect is also activated during the attack phase of a tone generator ADSR envelope modulation function. A start of tone signal is available from the note detect and assignor 14 which can be used in a manner already described for the RELEASE signal to initiate the addition of echoes during the attack phase.

A system modification is to replace the echo clock 106 and the counter 110 and 115 by a single counter that counts periods of the fundamental tone. This is simply a counter incremented by the note clock 37 and which is implemented to count $P \times 64$. P is the number of periods desired for the echo spacing and 64 is the number of data points for a waveshape period stored in the note register 35. This type of echo timing is automatically adaptive to the fundamental frequency of the generated musical tone. Thus for a constant release time, tones with a lower fundamental frequency will be generated with fewer echoes than tones having a higher fundamental frequency.

Figure 3:
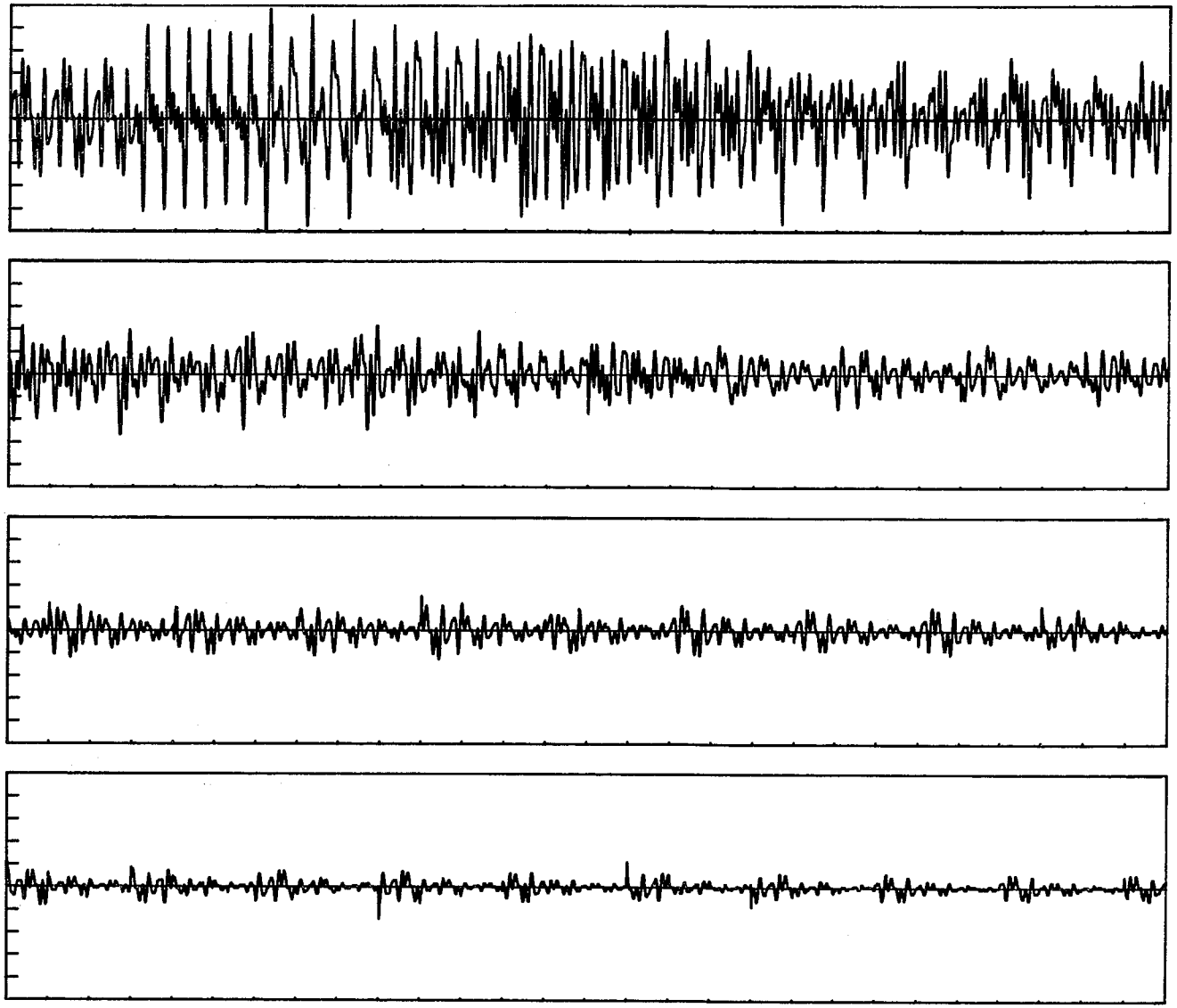
FIG. 3 is a plot of the output signal from the reverberation effect system.

FIG. 3 is a plot of the release phase of a signal at the input to the sound system 11. The original waveshape data comprising the master data set of 64 data points was generated with a spectral content of eight equal strength harmonics. The echoes were added at intervals of three periods with a random phase with respect to the current data read out of the note register 35. Each line on FIG. 3 represents 1792 data points of a folded plot of the entire release phase of a tone.

I claim:

1. In combination with a musical instrument having a waveshape memory storing a plurality of waveshape data points corresponding to the amplitudes of a corresponding number of evenly spaced points defining a period of a musical signal and in which said data points are sequentially and repetitively read out of the waveshape memory and transferred to a digital-to-analog converter at a rate corresponding to the pitch of the musical note being generated, apparatus for producing a reverberation effect comprising;

an echo memory means for storing data to be thereafter read out, a note clock for generating timing signals corresponding to the pitch of said generated musical note, a first addressing means responsive to said timing signals whereby data is sequentially and repetitively read out of said echo memory means, an adder means whereby data read out of said waveshape memory is added to data read out of said echo memory means to form an echo data set, a first data select means for storing said echo data set in said waveshape memory thereby creating said reverberation effect, and conversion means whereby data read out of said waveshape memory is converted to said musical signal.

2. Apparatus according to claim 1 wherein said musical instrument comprises;

an array of keyboard switches, a note detect means whereby a note detect signal is generated when a switch in said array of keyboard switches changes from an unactuated to an actuated state and whereby a note release signal is generated when a switch in said array of keyboard switches changes from an actuated state to an unactuated state, an envelope clock for generating envelope timing signals, and an envelope function generator responsive to said envelope timing signals wherein a sequence of attack data values are generated in response to said note detect signal and wherein a sequence of release data values are generated in response to said note release signal.

3. Apparatus according to claim 2 wherein said apparatus for producing a reverberation effect further comprises;

a first multiplier means interposed between said waveshape memory and said conversion means wherein data read out of said waveshape memory is multiplied by said attack data values in response to said note detect signal and wherein data read out of said waveshape memory is multiplied by said release data values in response to said note release signal, and a second multiplier means interposed between said echo memory means and said adder means wherein data read out of said echo memory means is multiplied by said attack data values in response to said note detect signal and wherein data read out of said echo memory means is multiplied by said release data values in response to said note release signal.

4. Apparatus according to claim 2 wherein said first data select means comprises;

an echo clock for generating echo timing signals, a counter means for counting said echo timing signals wherein said counter means is reset to an initial count state in response to said note detect signal and wherein said counter means is reset to an initial count state in response to said note release signal, and signal generating means responsive to count state of said counter means wherein said echo control signal is generated when said count state is equal to a preselected echo spacing control number.

5. In combination with a musical instrument having a waveshape memory storing a plurality of waveshape data points corresponding to the amplitudes of a corresponding number of evenly spaced points defining a period of a musical signal and in which said data points are sequentially and repetitively read out of the waveshape memory and transferred to a digital-to-analog converter at a rate corresponding to the pitch of the musical note being generated, apparatus for producing a reverberation effect comprising;

an array of keyboard switches, a note detect means whereby a note detect signal is generated when a switch in said array of keyboard switches changes from an unactuated state to an actuated state and whereby a note release signal is generated when a switch in said array of keyboard switches changes from an actuated state to an unactuated state, computing means whereby said plurality of waveshape data points are generated, a first memory means for storing said waveshape data points to be thereafter read out, a note memory means for storing data to be thereafter read out an echo memory means for storing data to be thereafter read out, an assignor means whereby data is read out of said first memory means and stored in said note memory means and in said echo memory means, a note clock for generating timing signals corresponding to the pitch of said generated musical note, an addressing means responsive to said timing signals whereby data is sequentially and repetitively read out of said note memory means and whereby data is sequentially and repetitively read out of said echo memory means, an adder means wherein data read out of said note memory means is added pointwise with data read out of said echo memory means to form an echo data set, generating means for creating an echo control signal, a first data select means whereby said echo data set is stored in said note memory means in response to said echo control signal, and conversion means whereby data read out of said note memory means is converted to said musical signal thereby creating said reverberation effect.

6. Apparatus according to claim 5 wherein said generating means comprises;

an envelope clock for generating envelope timing signals, an envelope function generator responsive to said envelope timing signals whereby a sequence of attack data values are generated in response to said note detect signals and whereby a sequence of release data values are generated in response to said note release signal, an echo clock for generating echo timing signals, an echo counter incremented by said echo timing signals wherein said echo counter is reset to an initial count state in response to said note release signal, and generating circuitry whereby said echo control signal is generated when said echo counter is incremented to a count state equal to a preselected echo spacing control number.

7. Apparatus according to claim 6 wherein said apparatus for producing a reverberation effect further comprises;

a first multiplier means, interposed between said note memory means and said adder means, whereby data read out from said note memory means is multiplied by said attack data values in response to said note detect signal and whereby data read out from said note memory means is multiplied by said release data values in response to said note release signal, and a second multiplier means, interposed between said echo memory means and said adder mean, whereby data read out from said echo memory means is multiplied by said attack data values in response to said note detect signal and whereby data read out from said echo memory means is multiplied by said release data values in response to said note release signal.

8. Apparatus according to claim 5 wherein said conversion means comprises a digital-to-analog converter.

* * * * *